US005853096A

United States Patent [19]

Bartur et al.

[11] Patent Number: 5,853,096

[45] Date of Patent: Dec. 29, 1998

[54] PRESSURE EQUALIZING AND FOAM ELIMINATING CAP

[76] Inventors: Maya H. Bartur; Meir Bartur, both of 11601 Terryhill Pl., Los Angeles, Calif. 90049

[21] Appl. No.: 756,113

[22] Filed: Nov. 25, 1996

[51] Int. Cl.[6] ..... B65D 53/00

[52] U.S. Cl. ..... 215/261; 215/307; 215/320; 215/344; 215/354

[58] Field of Search ..... 215/252, 261, 215/307, 314, 320, 344, 354

[56] References Cited

U.S. PATENT DOCUMENTS

| | | | |
|---|---|---|---|
| 3,038,624 | 6/1962 | Wieckmann | 215/320 |
| 3,100,577 | 8/1963 | Miller, Jr. et al. | 215/261 |
| 3,147,876 | 9/1964 | Lepore | 215/261 |
| 3,315,832 | 4/1967 | Scott | 215/261 |
| 3,951,293 | 4/1976 | Schulz . | |
| 4,093,105 | 6/1978 | Russell et al. . | |
| 4,398,645 | 8/1983 | Toeppen | 215/252 |
| 4,646,947 | 3/1987 | Stull | 222/397 |
| 4,648,519 | 3/1987 | Kennedy . | |
| 4,712,699 | 12/1987 | Lutz | 215/329 |
| 4,714,167 | 12/1987 | Sandhaus | 215/270 |
| 4,741,447 | 5/1988 | John | 215/252 |
| 4,997,097 | 3/1991 | Krautkramer | 215/307 |
| 5,020,683 | 6/1991 | Strassheimer | 215/354 |
| 5,305,900 | 4/1994 | Maguire et al. . | |
| 5,460,283 | 10/1995 | MaCartney et al. | 215/270 |

*Primary Examiner*—Stephen K. Cronin
*Attorney, Agent, or Firm*—Norton R. Townsley

[57] ABSTRACT

The present invention is a pressure equalizing and foam eliminating cap for a container. Pressure equalization and foam elimination is accomplished by designing the cap so that it can be rotated between a fully closed position, a gas venting position and a fully open position. This is accomplished in several ways. A first embodiment includes a spring biased, gas separation membrane between the cap and the mouth of the container. A second embodiment includes a finely, transversely perforated, annular plug on the underside of the cap and a seal between the plug and the interior of the neck. Alternatively, in this embodiment, the perforations may be larger and protected by a gas separation membrane. A third embodiment is similar to the second but incorporates two seals, one above and one below the perforations. In this embodiment also, the perforations may be larger and protected by a gas separation membrane. A fourth embodiment has two annular seals, the outer one being larger and having transverse perforations, depending from the underside of the cap. A fifth embodiment is similar to the second except that the plug is not perforated and the seal has fine, outer, axial grooves or scores. A sixth embodiment has two threaded caps which screw onto each other. The inner cap has micro perforations or a section of gas separating membrane in its top. A seventh embodiment is similar to the sixth embodiment except that the outer cap is a flip cap which may be hingedly attached to the inner cap.

21 Claims, 10 Drawing Sheets

PRESSURE EQUALIZING AND FOAM ELIMINATING CAP

BACKGROUND OF THE INVENTION

The present invention relates to the field of caps for containers geared to accommodate liquids and vapor at higher than atmospheric pressure. Such containers are usually equipped with externally threaded necks. More particularly, the invention relates to bottle caps which allow for pressure equalization at opening and which eliminate the release of mixtures of gas and liquid from the interiors of such containers at opening.

Carbonated beverages are commonly sold in cans and in bottles. Bottles for carbonated beverages are made of glass or plastic which are usually sealed with threaded, tamper proof, plastic caps.

Upon initial opening of bottles of carbonated beverages, it is common for some gas and liquid, which for convenience will be designated "foam" in this application, to escape out of the mouth of the bottle. There are many reasons for this: the beverage may have been over-pressurized at the factory, the bottle may have been shaken before opening, the bottle and its content may have been overcooled so that the liquid becomes partially frozen and the gas no longer dissolves in the liquid thus increasing its partial pressure, or the beverage may have been made at a lower elevation than the elevation at which the beverage is ultimately consumed. Whatever the reason, the escaping liquid frequently makes an annoying, sticky mess which must be cleaned up.

Many hazardous materials are volatile and experience an increase in the internal vapor pressure upon storage in a container. Upon opening, containers of these hazardous materials, will release fumes and may also release foam. In the case of hazardous materials, the mess is not just annoying but may in fact be dangerous. Controlled release of internal vapor pressure prior to opening the container for liquid dispensing is highly desirable.

Development of a bottle cap which can equalize pressure and eliminate foam represents a great improvement in the field of caps for containers with externally threaded necks and satisfies a long felt need of the consumer of carbonated beverages and the user of hazardous materials.

SUMMARY OF THE INVENTION

The present invention is a cap for bottles of carbonated beverages and containers of volatile hazardous liquids which is capable of equalizing pressure and eliminating release of foam as the cap is removed from the bottle or container. Pressure equalization and foam elimination are accomplished by designing the cap so that it can be rotated, preferably continuously, between a fully closed position, a gas venting position and a fully open position.

There are several embodiments that will accomplish the objectives of this invention. In a first embodiment, a spring biased, gas separation membrane is retained between the cap and the mouth of the container. A second embodiment includes a finely, transversely perforated, annular plug on the underside of the cap which can slide into the neck or mouth and a seal or seals between the plug and the interior of the neck or mouth. The fine perforations function as a gas separation membrane. A modification of this embodiment incorporates an additional gas separation membrane at the tip or the inside of the annular plug thus allowing larger holes. A third embodiment is similar to the second but incorporates at least two seals, one set above and one set below the perforations. This embodiment can also be modified by incorporating an additional gas separation membrane at the tip or the inside of the annular plug. A fourth embodiment has two annular seals depending from the underside of the cap. The outer seal is larger and has fine, transverse perforations. A fifth embodiment is similar to the second embodiment except that the plug is not perforated and the seals have fine, outer, axial grooves or scores. A sixth embodiment has two threaded caps which screw onto each other. The inner cap has micro perforations or a section of gas separating membrane in its top. A seventh embodiment is similar to the sixth embodiment except that the outer cap is a flip cap which may be hingedly attached to the inner cap.

An appreciation of the other aims and objectives of the present invention and an understanding of it may be achieved by referring to the accompanying drawings description of a preferred embodiment.

BRIEF DESCRIPTION OF THE DRAWINGS

FIG. 1A shows the first embodiment in the fully closed position on the neck of a bottle.

FIG. 1B shows the first embodiment in the gas venting position.

FIG. 1C shows the first embodiment in the fully open position.

FIG. 8A shows the seventh embodiment fully closed.

FIG. 8B shows the seventh embodiment in the partially opened, gas venting position.

FIG. 8C shows the seventh embodiment fully open gas venting position.

DETAILED DESCRIPTION OF THE PREFERRED EMBODIMENTS

Figure 1A:
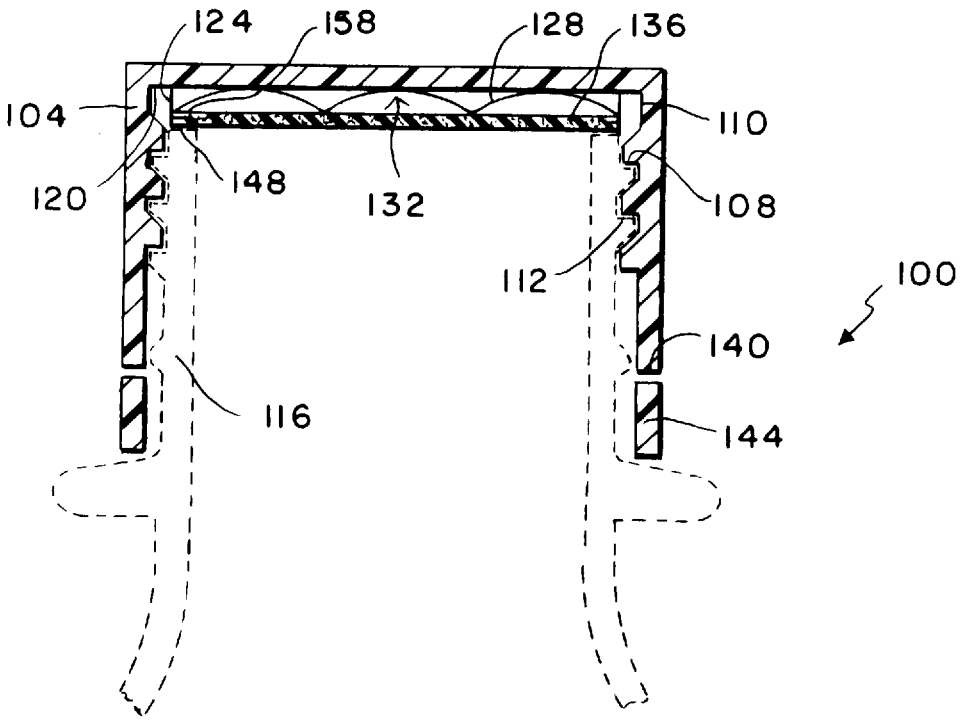
FIGS. 1A–1C are cross-sections of a first embodiment of the foam eliminating bottle cap which includes a spring retained gas separation membrane.
Figure 1B:
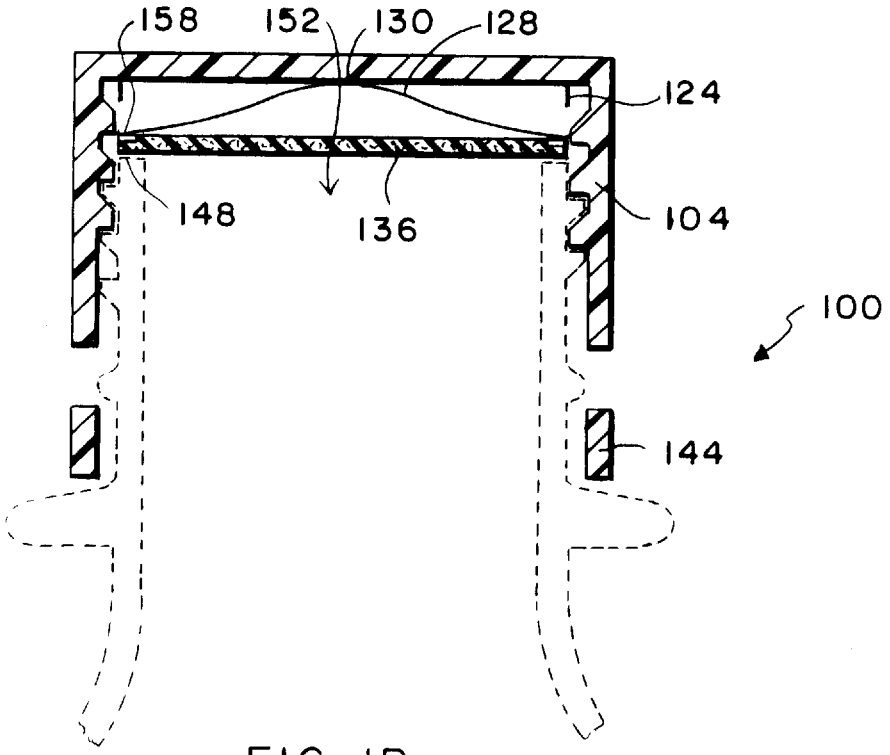
Figure 1C:
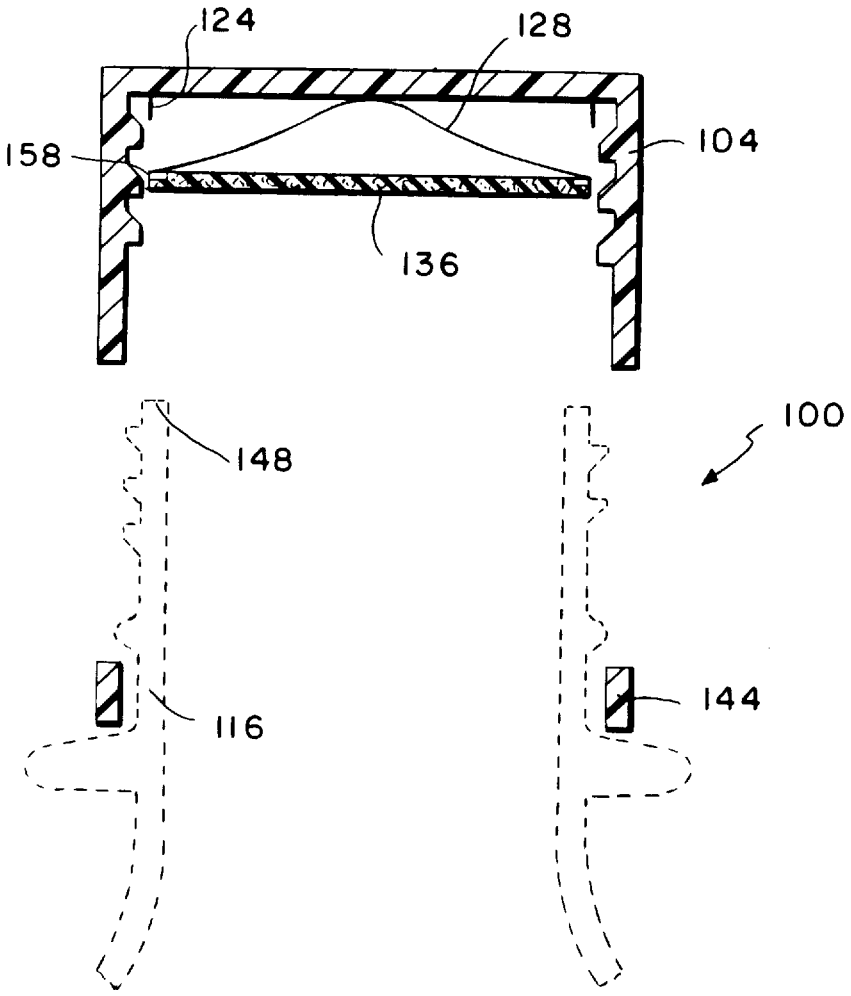

FIGS. 1A–1C show cross-sections of the first embodiment 100. The first embodiment 100 is made of a cap 104 which has internal threads 108 on its interior wall 110. These threads 108 are designed to mate with the external threads 112 on the neck or mouth of a bottle or container 116. The cap 104 has an underside 120 on which is an approximately centrally located, annular sealing ring 124. The annular ring 124 may be a separate element fastened to the underside 120 or it may be integral with the cap 104. The ring 124 can be made from a material that is softer than the cap material and thus more pliable to conform to the top lip portion 148 of the bottle neck 116, and provide a tight seal in the closed position.

Attached to the cap 104 is a spring 128 which is shaped like a disk with openings in it and an annular ring 158 around it. In its relaxed state, this spring 128 assumes a convex shape. When compressed, the spring 128 becomes flatter. The spring 128 is designed so that when fully compressed it fits inside the annular sealing ring 124. The spring 128 may be fastened at its center (i.e. at one end) 130 to the center 132 of the underside 120 by any convenient means or it may be loosely retained by retaining ridges (not illustrated) built into or fastened onto the cap 104. Other spring 128 configurations can be conceived that would function well in this invention.

Tightly fastened to the ring portion (i.e. the other end) 158 of the spring 128 is a thin disk made of a gas permeable material 136. The disk 136 is sized so that it fits within the annular seal 124. The disk 136 may be attached to the spring 128 all around its outer ring 158 by adhesive, or by thermal, rf or ultrasonic welding.

Membranes of gas permeable materials allow gasses to pass through but prevent liquids from passing through. The preferred gas permeable material should be hydrophobic with a pore size of less than 0.2 microns and water breakthrough pressure of at least 15 psi. It should also be bio-safe; sealable by RF, heat or ultrasonic energy; sterilizable; and available as roll stock. The preferred materials are Versapor R or H available from Gelman Sciences of Ann Arbor, Mich., USA. These are made of an acrylic copolymer on a non-woven Nylon support, and post treated for hydrophobicity by UV polymerization. Another such material is made from unsintered tetrafluoroethylene with a fibrillated structure and a density of less than about 1.4 and is usually from 0.1 to 3 mm thick. This material is manufactured under the trademark Gore-Tex and is manufactured by W. L. Gore & Co. GmbH of Germany. Yet another such material is a mixed polymer such as tetrafluoroethylene/hexafluoropropylene, which may be surface sintered. Still another such materials is TF-200 available from Gelman Sciences of Ann Arbor, Mich., USA.

Attached to the bottom 140 of the cap 104 is a conventional tamper proofing device 144 that breaks loose after the first opening of the bottle. The tamper proofing device 144 is a standard device that renders bottles difficult to open for young children and provides a visual indication of whether the bottle, and more particularly its contents, have been tampered with prior to sale.

FIG. 1A shows the first embodiment 100 in the fully closed position. In this position, the cap 104 is fully threaded onto the threads 112 of the bottle neck 116, the seal ring 124 is in firm contact with top 148 of the bottle neck 116, and the spring 128 is in its fully compressed state. When the cap 104 is in this position, the seal 124 prevents escape of liquid and gas from the inside of the bottle.

FIG. 1B shows the first embodiment 100 in the gas venting position. In this position, the tamper proof device 144 has been broken, the cap 104 has been un-threaded by about a part of a turn, the spring 128 is still in a compressed state, and the seal 124 is no longer in intimate contact with the top 148 of the bottle neck 116. The gas permeable disk 136 is firmly held over the mouth of the bottle 152 by the tension in the spring 128. Because of the physical properties of the membrane 136, gas can now escape but not liquid. Consequently, excessive gas pressure can be relieved from the inside of the bottle without the possibility of any foam. The path that escaping gas can take is show by the arrow 154.

FIG. 1C shows the first embodiment 100 in the fully open position. In this position, the tamper proof device 144 has been separated, the cap 104 has been fully un-threaded, the spring 128 is in its fully relaxed state, and neither the seal 124 nor the membrane 136 is in contact with the top 148 of the bottle neck 116. The cap 104 can be completely removed from the bottle neck 116 allowing liquids to be poured out of the bottle.

Figure 2:
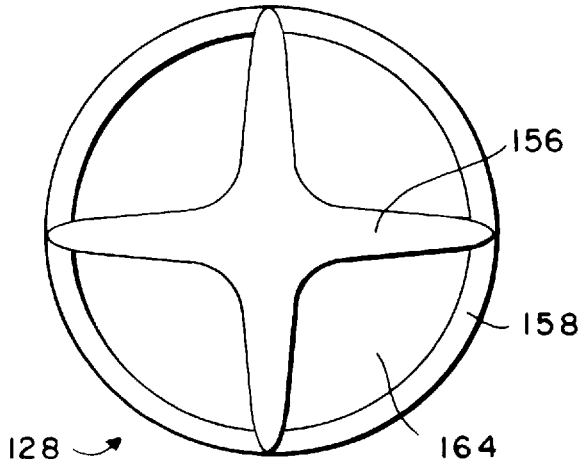
FIG. 2 is a top view of the spring retainer used in the first embodiment.

FIG. 2 is a top view of the spring retainer 128 used in the first embodiment. The spring as illustrated has four arms 156. However, it will be readily appreciated that springs 128 can be designed to have any number of arms 156 or to have a completely different design. The important point is that the there are openings 164 in the spring 128, between the arms 156 and the perimeter ring 158, so that the spring 128 does not form an impermeable barrier.

Figure 3:
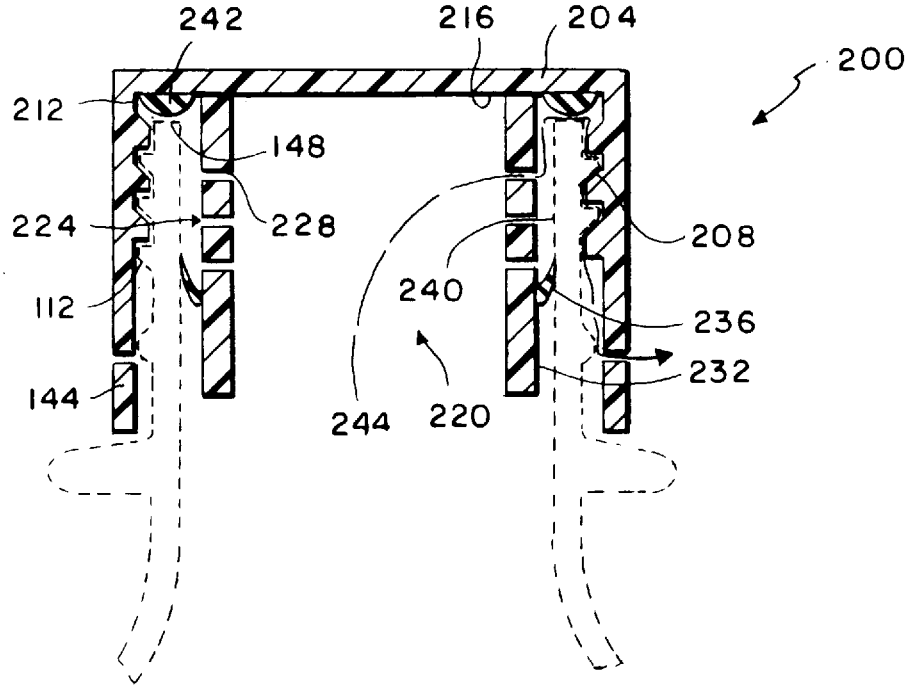
FIG. 3 is a cross-section of a second embodiment of the foam eliminating bottle cap which includes a micro-perforated interior projection, an interior seal or flap and a top gasket, in the gas venting position.

FIG. 3 is a cross-section of the second embodiment 200 in the gas venting position. The second embodiment 200 is made of a cap 204 which has internal threads 208 on its interior wall 212. These threads 208 are designed to mate with the external threads 112 on the neck or mouth of a bottle 116. The cap 204 has an underside 216 on which is an approximately centrally located, annular plug or interior projection 220. The plug 220 may be a separate element fastened to the underside 216 or it may be integral with the cap 204. A central area 224 of the plug or interior projection 220 has multiple, fine, transverse perforations 228 through it. The perforations 228 may be molded in or, preferably, fabricated by laser drilling. The diameter of each perforation 228 is, preferably, about 0.003 inches or less. Such perforations will allow gasses to pass but prevent liquids from passing. On the outside 232 of the plug 220 but below this area 224, is an annular seal or flap 236. The seal 236 could be an O-ring retained in a groove or, as illustrated in FIG. 3, a flap with an upwards curve, made integral with the plug 220. The seal or flap 236 makes a slidable, pressure and liquid proofjoint between the inside 240 of the bottle neck 116 and the plug 220. It will be obvious to people familiar with the art to which this invention pertains that multiple seals or flaps 236 could be employed and the plug 220 may be constructed with internal support beams or tapered walls to increase the stability and rigidity of the walls and to provide support for the seal or flap 236. This internal reinforcement of the plug structure is applicable to all the embodiments that deploy a plug as a part of the cap structure. This embodiment 200 also includes an annular gasket 242, fastened to the underside 216 of the cap 204, between the top 148 of the bottle neck 116 and the cap 204, and a tamper proofing device 144.

When this embodiment 200 is fully screwed on, the gasket 242 is compressed and neither gas nor liquid can escape from the bottle. When this embodiment 200 is unscrewed slightly, the gasket 242 becomes uncompressed. Excess gas pressure is vented through the perforations 228 and past the gasket 242 and between the partially open threads 112 and 208. This escape path is illustrated by the arrow 244. The seal or flap 236 prevents escape of liquid past the plug 220 until the cap 204 is fully removed.

Figure 3B:
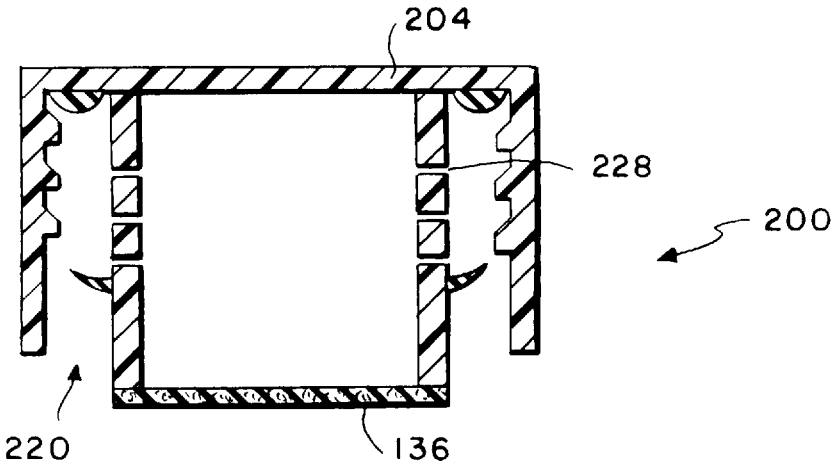
FIG. 3B illustrates one version of the second embodiment which is a modification of the cap depicted in FIG. 3 by incorporation of a gas separation membrane at the tip of the interior projection.

FIG. 3B shows a modification of the second embodiment 200 that incorporates a gas separation membrane 136 at the bottom of the plug 220. This modified construction allows for larger holes 228 that are customarily achievable in plastic molding. The membrane 136 is secured to the plug 220 via plastic weld or glue all around the periphery. The path of escaping gas in the partially open position is similar to the one described in FIG. 3.

Figure 3C:
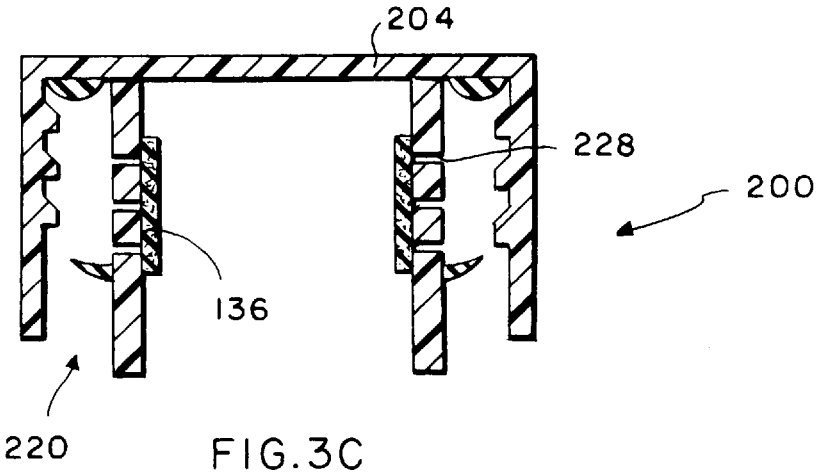
FIG. 3C illustrates another version of the second embodiment which is a modification of the cap depicted in FIG. 3 by incorporation of gas separation membrane at the inside surface of the interior projection.

FIG. 3C shows another modification of this second embodiment 200. In this modification, the gas separation membrane 136 is in tubular form and placed inside the plug 220. Again, this modification allows use of relatively large holes 228. The membrane 136 can be incorporated in the plug 220 during molding or welded or glued in afterwards. The membrane 136 can be tubular or have other configurations that cover the perforations 228 completely.

Figure 4:
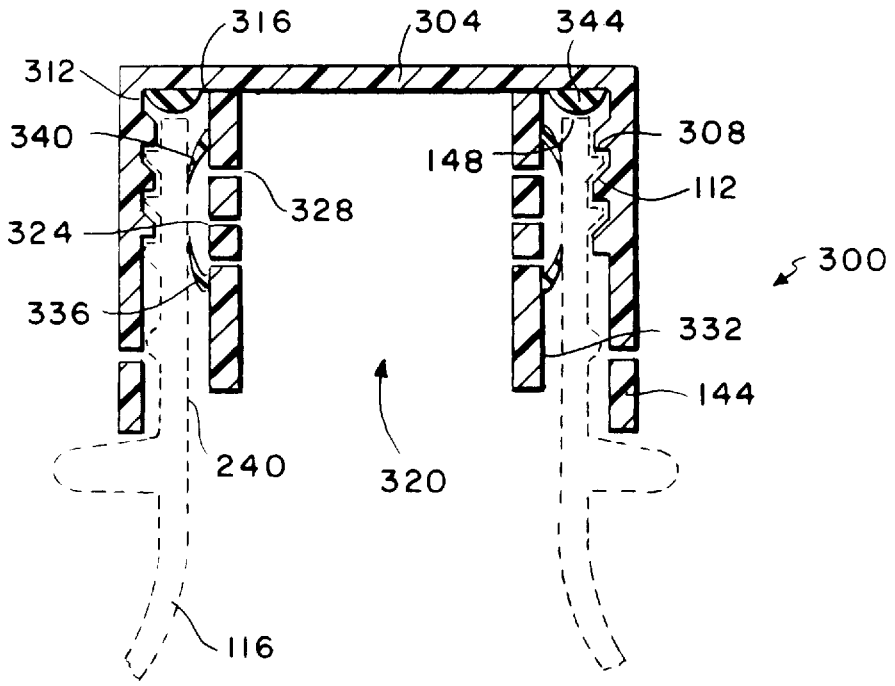
FIG. 4 is a cross-section of a third embodiment of the foam eliminating bottle cap which includes a micro-perforated interior projection, two interior seals or flaps and a top gasket, in the closed position.

FIG. 4 is a cross-section of the third embodiment 300 in the closed position. The third embodiment 300 is made of a cap 304 which has internal threads 308 on its interior wall 312. These threads 308 are designed to mate with the external threads 112 on the neck or mouth of a bottle 116. The cap 304 has an underside 316 on which is an approximately centrally located, annular plug or interior projection 320. The plug 320 may be a separate element fastened to the underside 316 or it may be integral with the cap 304. A central area 324 of the plug 320 has multiple, fine, transverse perforations 328 through it. The perforations 328 may be molded in or, preferably, fabricated by laser drilling. The diameter of each perforation 328 is, preferably, about 0.003 inches or less. Such perforations will allow gasses to pass but prevent liquids from passing. On the outside 332 of and integral with the plug 320 but above and below this area 324, are an upwards sweeping annular wiper seal or flap 336 and a downwards sweeping annular wiper seal or flap 340. Alternatively, the seals 336 and 340 could be O-rings retained in grooves. The seals or flaps 336 and 340 make a slidable, pressure and liquid proofjoint between the inside 240 of the bottle neck 116 and the plug 320. It will be obvious to persons familiar with the art to which this invention pertains that multiple seals or flaps 336 and 340 could be employed. This embodiment 300 also includes an annular gasket 344, fastened to the underside 316 between the top 148 of the bottle neck 116 and the cap 304, and a tamper proofing device 144.

When this embodiment 300 is fully screwed on, the gasket 344 is compressed and neither gas nor liquid can escape from the bottle. When this embodiment 300 is unscrewed, the gasket 344 becomes uncompressed but the upper seal or flap 340 must clear the bottle neck 116 before any gas can escape. When the upper seal or flap 340 clears the top 148, excess gas pressure is vented through the perforations 328 and past the gasket 344. The lower seal or flap 336 prevents escape of liquid past the plug 320 until the cap 304 is fully removed. It will be readily understood that this embodiment 300 can be modified with sections of gas separation membrane similar to the modifications shown on FIGS. 3B and 3C. This again allows use of larger perforations 328 which are more readily achievable with conventional plastic molding.

Figure 5:
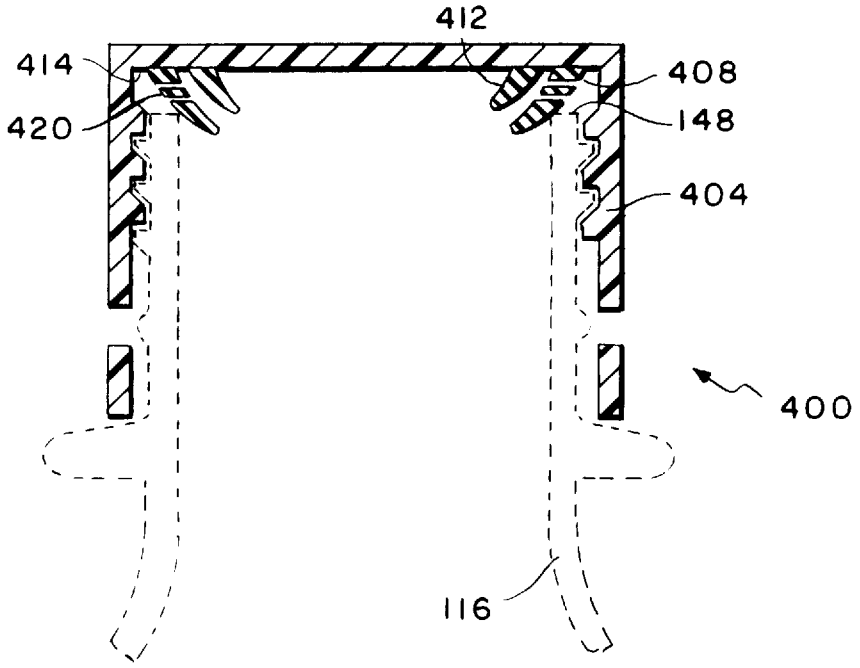
FIG. 5 is a cross section of a fourth embodiment of the foam eliminating bottle cap which includes two depending, annular seals or flaps, in the gas venting position.

FIG. 5 is a cross section of the fourth embodiment in the gas venting position. This embodiment comprises a cap 404 with two annular seals or flaps 408 and 412. These seals or flaps 408 and 412 are approximately centrally located on the underside 414 of the cap 404 and sweep inwards so as to interfere with the top 148 of the bottle neck or mouth 116 as shown on FIG. 5. The outer seal or flap 408 has the larger diameter and length, and is perforated by multiple, fine, transverse perforations 420. The perforations 420 may be molded in or, preferably, fabricated by laser drilling. The diameter of each perforation 420 is, preferably, about 0.003 inches or less. Such perforations will allow gasses to pass but prevent liquids from passing. The inner seal or flap 412 is shorter and solid. The fourth embodiment also includes a tamper proofing device 144.

When the fourth embodiment 400 is fully screwed on to the bottle neck 116, the inner seal or flap 412 is compressed against the outer seal or flap 408. This effectively seals off the perforations 420 so that neither gas nor liquid can escape from the bottle. As the cap is unscrewed slightly the inner seal or flap 408 lifts away from the outer seal or flap 412 but the outer seal or flap 412 still interferes with the bottle neck 116. In this position, which is the position illustrated in FIG. 5, excess gas pressure can escape through the perforations 420. This escape path is illustrated by the arrow 416.

Figure 6:
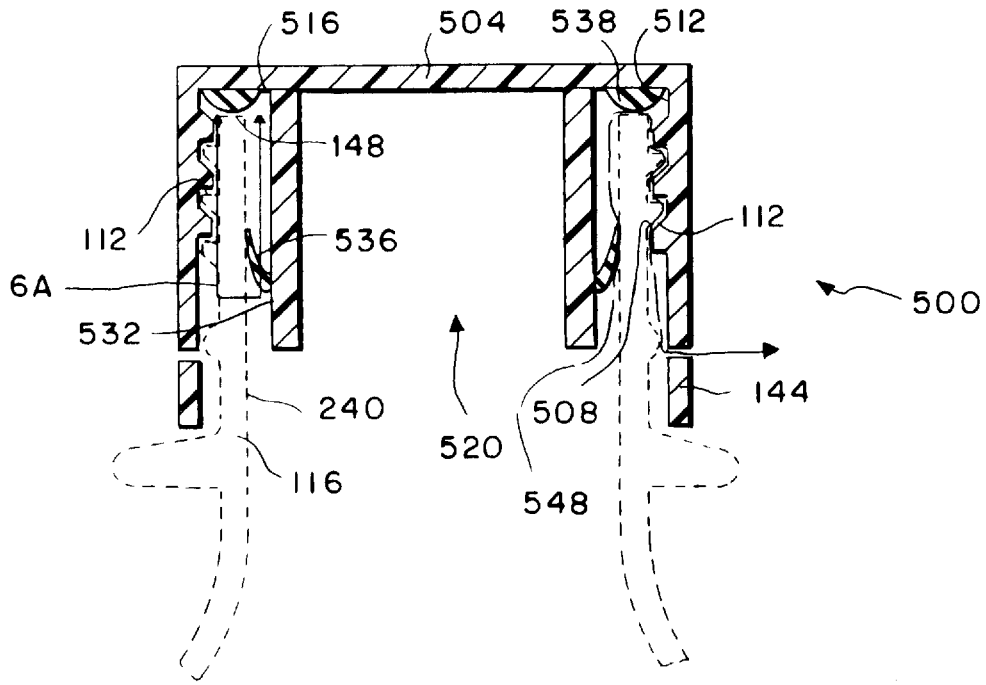
FIG. 6 is a cross-section of a fifth embodiment of the foam eliminating bottle cap which includes an interior projection, a interior seal or flap with controlled roughness and a top gasket, in the gas venting position.

FIG. 6 is a cross-section of the fifth embodiment 500 in the gas venting position. The fifth embodiment 500 is made of a cap 504 which has internal threads 508 on its interior wall 512. These threads 508 are designed to mate with the external threads 112 on the neck or mouth of a bottle 116. The cap 504 has an underside 516 on which is an approximately centrally located, annular plug or interior projection 520. While an annular plug 520 is illustrated on FIG. 6, it will be understood by those familiar with the art to which this invention pertains that the plug 520 could alternatively be solid or internally supported by beams or crossover members. The plug 520 may be a separate element fastened to the underside 516 or it may be integral with the cap 504. On the outside 532 of the plug 520 is an annular seal or flap 536. The seal 536 could be an O-ring retained in a groove or, as illustrated in FIG. 3, a flap with an upwards curve, made integral with the plug 520. However, the seal or flap 536 has multiple, fine, axial corrugations or scores on its outer surface (see FIG. 6A). The seal or flap 536 makes a slidable joint between the inside 240 of the bottle neck 116 and the plug 520. This embodiment 500 also includes an annular gasket 538 fastened to the underside 516 between the top 148 of the bottle neck 116 and the cap 504, and a tamper proofing device 144.

While a singular seal or flap 536 is illustrated in FIG. 6, it will readily be appreciated by those familiar with the art to which this invention pertains that multiple seals or flaps 536 could be employed. This is illustrated in FIG. 6B. Furthermore, the seal or flap 536 could be augmented by un-scored seals or flaps 542, 550 above and below it. In the latter case, there would have to be perforations 546 through the plug 520 between the lower un-scored seals or flaps 542 and the scored seal 536. These variations are illustrated in FIGS. 6B, 6C and 6C. For purposes of this document, the lower un-scored seal 542 will be designated the second un-scored seal 542 and the upper unscored seal 550 will be designated the third un-scored seal 550.

Figure 6A:
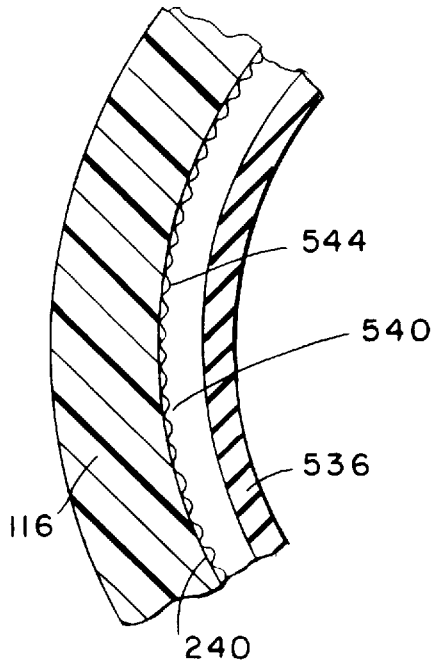
FIG. 6A is a cross-section taken along the line 6A—6A on FIG. 6.
Figure 6B:
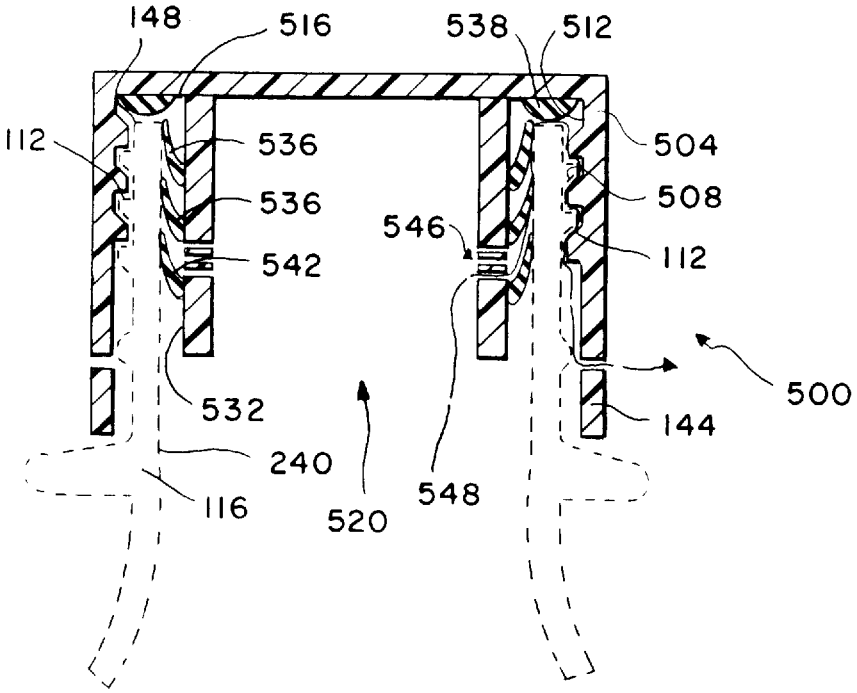
FIG. 6B is a cross-section of a variation of the fifth embodiment which has two scored seals or flaps, a second, lower un-scored seal or flap, and perforations through the plug, in the gas venting position.
Figure 6C:
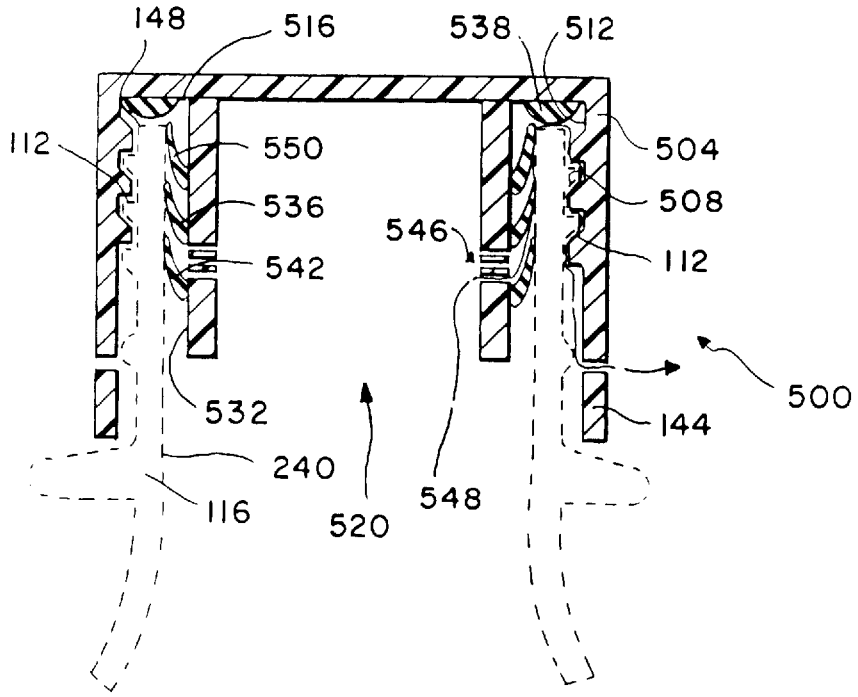
FIG. 6C is a cross-section of another variation of the fifth embodiment which additionally has a second, lower un-scored seal or flap, a third, upper un-scored seal or flap, and perforations through the plug, in the gas venting position.
Figure 6D:
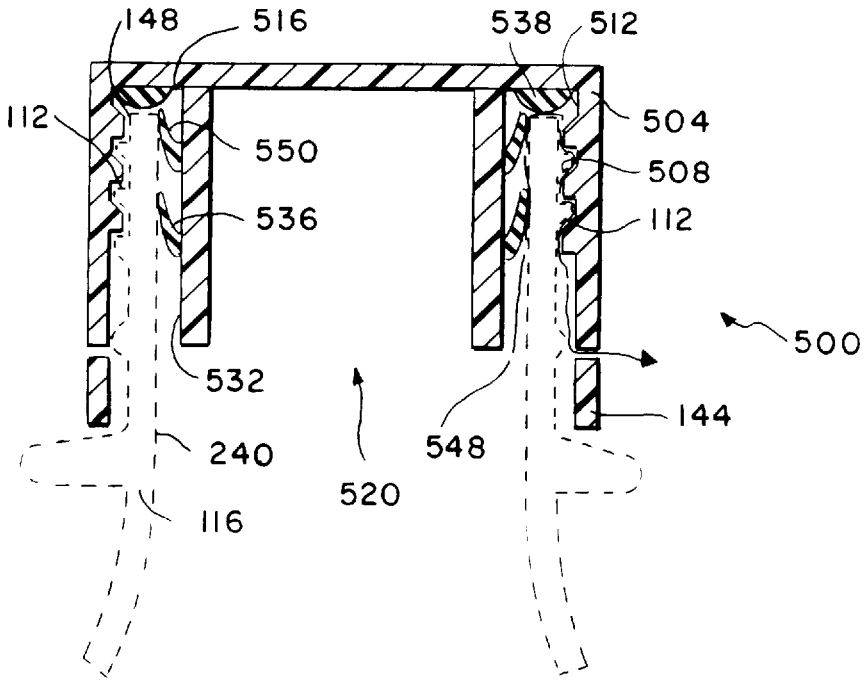
FIG. 6D is a cross-section of yet another variation of the fifth embodiment which has the third, upper un-scored seal or flap, and perforations through the plug, in the gas venting position.

FIG. 6A is a cross-section taken along the line 6A—6A on FIG. 6. Consequently, it is a cross-section of the seal or flap 536. The outer edge 540 of the seal or flap 536 has multiple, very fine corrugations or vertical scores 544, on the order of 0.003 inches or less. This feature functions like a gas permeable membrane: i.e. it will allow gas to pass but not liquid.

When this embodiment 500 is fully screwed on, the gasket 538 is compressed and neither gas nor liquid can escape from the bottle. When this embodiment 500 is unscrewed slightly, the gasket 538 becomes uncompressed. In this state it will allow gas and liquid to pass. However, the corrugations or scores 544 on the outer edge 540 of the seal or flap 536 prevent liquid from passing. Excess gas pressure is vented through the corrugations or scores 544 and past the gasket 538. This escape path is illustrated by the arrow 548.

Figure 7:
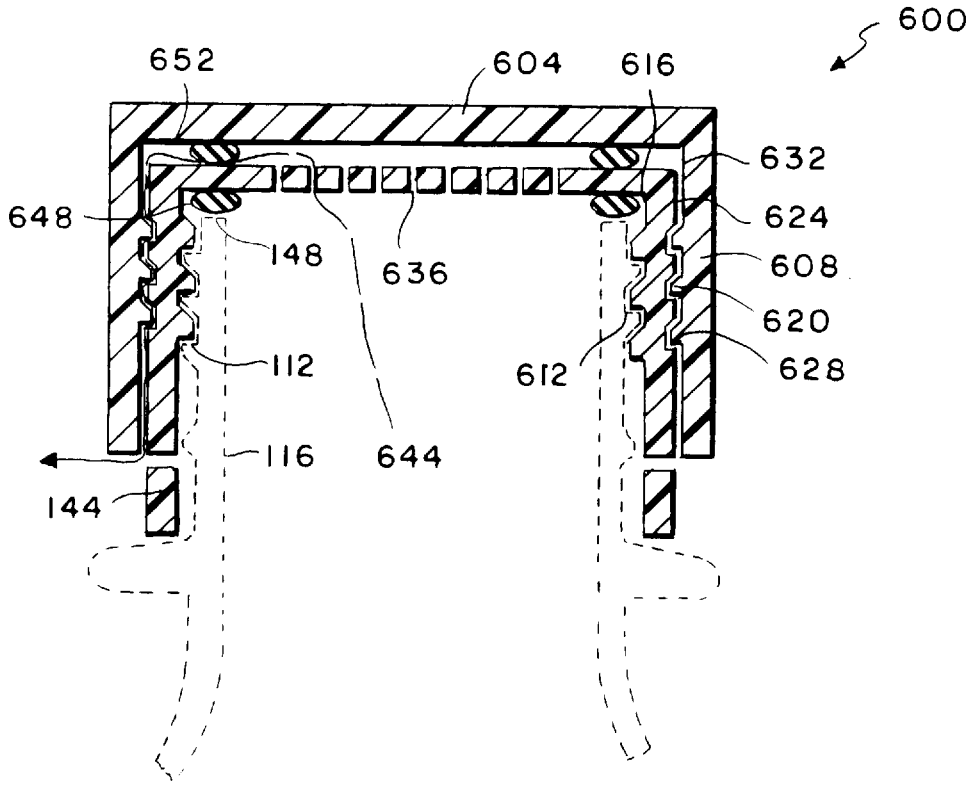
FIG. 7 is a cross-section of a sixth embodiment of the foam eliminating bottle cap which includes an interior threaded cap having a gas separating membrane or micro perforated top and an exterior threaded cap, in the gas venting position.

FIG. 7 is a cross-section of the sixth embodiment 600 in the gas venting position. This embodiment 600 includes an inner cap 604 and an outer cap 608. The inner cap has inner threads 612 on its inner wall 616 and outer threads 620 on its outer wall 624. The inner threads 612 are designed to mate with the external threads 112 on the neck or mouth of a bottle 116. The outer cap 608 has inner threads 628 on its inner wall 632 which are designed to mate with the outer threads 620 of the inner cap 604. Approximately in the center of the top wall 640 of the inner cap 604 is an area 636 of gas permeable membrane made of materials previously described. Alternatively the center of the top 640 is pierced by many fine holes or perforations 636. The perforations 636 may be molded in or, preferably, fabricated by laser drilling. The diameter of each perforation 636 is, preferably, about 0.003 inches or less. Such perforations will allow gasses to pass but prevent liquids from passing. Thus, they function like a gas permeable membrane. In addition, to effect more efficient sealing, there are be gaskets or integral lands 648, 652 between the caps 604 and 608 and the inner cap 604 and the top 148 of the bottle neck 116. This sixth embodiment 600 also incorporates a tamper device 144.

When both caps 604 and 608 are fully screwed down, neither gas nor liquid can escape from the bottle. When the outer cap is slightly unscrewed, so that the lands or gaskets 648, 652 between the caps clears their mating surfaces, gas may escape from the bottle through the fine holes or membrane 636. This escape path is shown the arrow 644. To pour the carbonated beverage from the bottle, both caps 604 and 608 must be removed. To store the beverage without losing the carbonation, both caps 604 and 698 must be screwed back on tightly. Thus after initial opening; both caps 604 and 608 should be used together as a unit. The outer threads 620 of the internal cap 640 and the inner threads 628 of the top cap 608 are designed to open more easily than the internal set of threads 112, 612. Also a stop (not illustrated) can be incorporated to limit the travel of the outer cap 608 so that after up few turns further movement is impossible and the opening torque is coupled to the inner cap 604. Such an arrangement will enable the user to apply continuous rotating motion for opening. This means that, when opening a sealed container, initially the outer cap 608 will rotate and open, venting the gas, then further rotation will open the inner cap 604 and allow liquid dispensing. The optional thread stop described above will retain the two cap 604, 608 assembly as a single unit for the user to re-close the container.

Figure 8A:
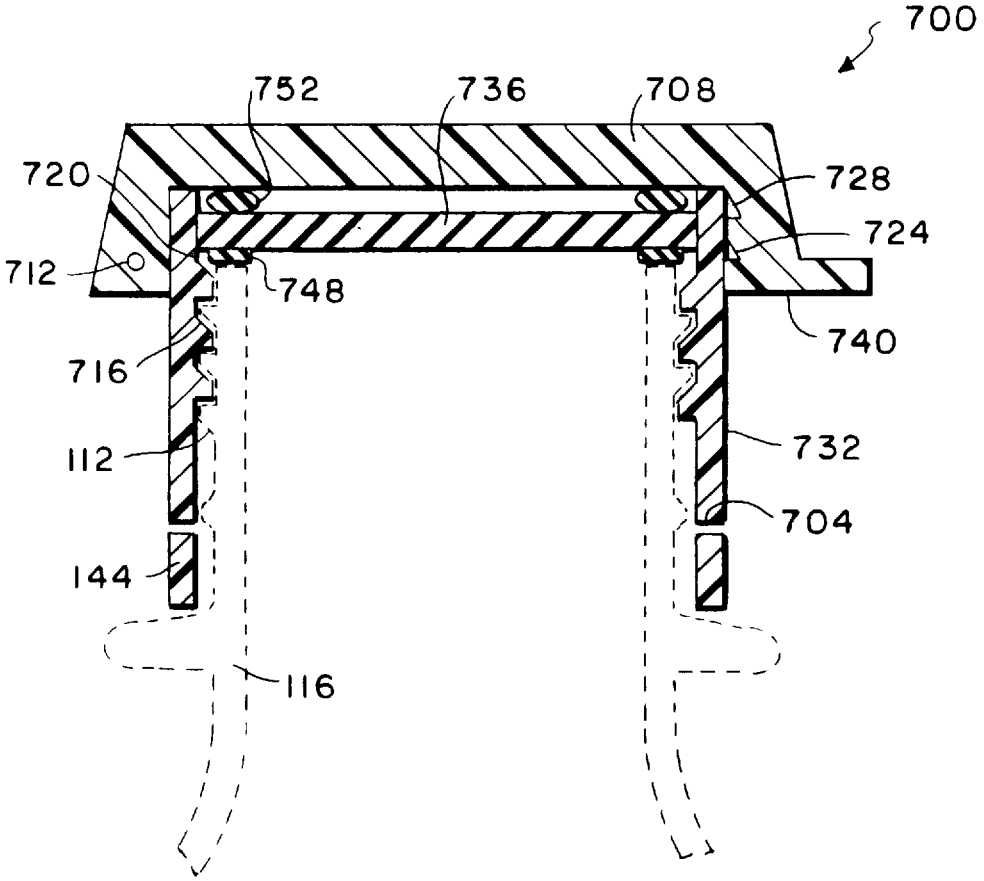
FIGS. 8A–8C are cross-sections of a seventh embodiment of the foam eliminating bottle cap which includes an interior threaded cap having a gas separating membrane or micro perforated top and an outer flip cap.
Figure 8B:
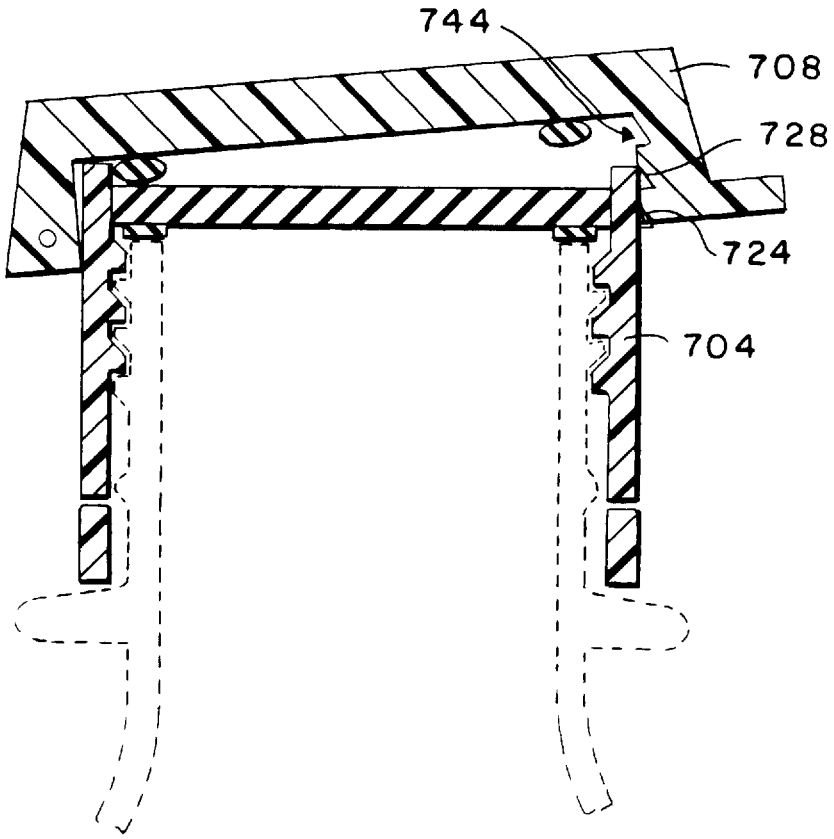
Figure 8C:
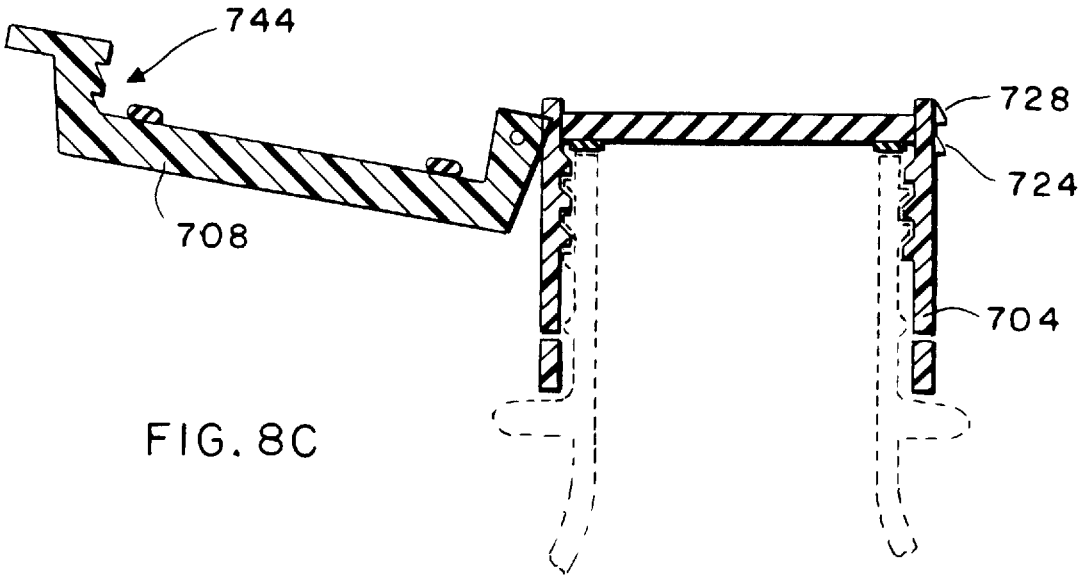

FIGS. 8A–8C are cross-sections of the seventh embodiment 700. This embodiment 700 includes an inner screw cap 704 and an outer, flip cap 708. The two caps 704 and 708 are attached to each other by a hinge or other holding means 712. The holding assembly 712 holds the two caps 704 and 708 together permanently or non-permanently. The inner cap 704 has internal threads 716 on its inner wall 720 which are designed to mate with the external threads 112 of a bottle neck or mouth 116. It also has first 724 and second 728 serrations on its outer wall 732. The top 736 of the inner cap 704 is made of a gas permeable material, as previously described. Alternatively, it can be perforated with fine holes as described above.

The flip cap 708 has an actuating ledge 740 and an interior notch 744, which matches the shape of the serrations 724 and 728, so that the flip cap 708 can be retained in a fully closed or gas venting position. The flip cap 708 is moved from one position to the other by manual pressure applied to the actuating ledge 740. There is a gasket 748 between the top 148 of the bottle neck 116 and the inner cap 704. An additional gasket 752 between the rotating cap body 704 and the flip top 708 may be installed to improve sealing if required. The seventh embodiment 700 also incorporates a tamper device 144.

While singular serrations 724 728 are illustrated, it will be readily understood by those familiar with the art to which this invention pertains that multiple serrations 724 728 could be employed. This would necessitate redesign of the interior notch 744 to match the number of serrations 724 728.

FIG. 8A shows the seventh embodiment 700 fully closed. In this position, the notch 744 engages the first and second serrations 724 and 728 and neither gas nor liquid can escape from the bottle.

FIG. 8B shows the seventh embodiment 700 in the partially opened, gas venting position. In this position the notch 744 engages the second serration and 728 and only gas can escape from the bottle.

FIG. 8C shows the seventh embodiment 700 gas venting position. In this position, again, only gas can escape from the bottle. To pour liquid, the entire assembly of the inner and outer caps 704 and 708 must be unscrewed from the bottle.

Clearly, the major application for this invention is caps for beverage containers. Consequently, it will be obvious to those familiar with the art to which this invention pertains that most pressure equalizing and foam eliminating caps will be fabricated from a variety of plastics by well known methods of injection molding. However, if caps made in accordance with this invention are to be used with containers of hazardous materials, some modification of the above presented designs may be necessary. Such modifications may include elimination of the tamper seal and full or partial fabrication from chemical resistant materials that may be not be moldable such as Teflon and/or stainless steel.

Several embodiments 100, 200, 300, 400, 500, 600 and 700 with several modifications for a pressure equalizing and foam eliminating cap have been described. Other modifications and enhancements can be made without departing from the spirit and scope of the claims that follow.

LIST OF REFERENCE NUMERALS

110 First embodiment of foam eliminating cap
104 Cap member
108 Internal threads of cap member
110 Interior wall of cap member
112 External threads of the neck of the container
116 Neck or mouth of container
120 Underside of cap member
124 Annular seal
128 Spring
130 Center attachment point or one end of spring
132 Center of underside of cap member
136 Gas permeable membrane
140 Bottom of cap member
144 Breakaway ring of tamper proofing device
148 Top surface of neck, the sealing lip of the container neck
152 Mouth of container
154 Path of escaping gas
156 Arms of spring
158 Membrane retaining ring part or other end of spring
164 Opening
200 Second embodiment of foam eliminating cap
204 Cap member
208 Internal threads of cap member
212 Interior wall of cap member
216 Underside of cap member
220 Annular plug or interior projection
224 Central area of plug
228 Perforations
232 Outside of plug or interior projection
236 Seal or flap
240 Inside of bottle neck
242 Annular gasket
244 Path of escaping gas
300 Third embodiment of foam eliminating cap
304 Cap member
308 Internal threads of cap member
312 Interior wall of cap member
316 Underside of cap member
320 Annular plug or interior projection
324 Central area of plug
328 Perforations
332 Outside of plug or interior projection
336 Upwards sweeping seal or flap
340 Downwards sweeping seal or flap
344 Gasket
400 Fourth embodiment of foam eliminating cap
404 Cap member
408 Outer, annular depending seal or flap
412 Inner, annular depending seal or flap
414 Underside of cap
416 Path of escaping gas
420 Perforation
500 Fifth embodiment of foam eliminating cap
504 Cap member
508 Internal threads of cap member
512 Interior wall of cap member
516 Underside of cap member
520 Plug or interior projection
532 Outside of plug or interior projection
536 Scored seal or flap
538 Gasket
540 Outer edge
542 Lower or second un-scored seal or flap
544 Corrugations or scores
546 Transverse perforations
548 Path of escaping gas
550 Upper or third un-scored seal or flap
600 Sixth embodiment of foam eliminating cap
604 Inner cap member
608 Outer cap member
612 Inner threads of inner cap member
616 Inner wall of inner cap member
620 Outer threads of inner cap member
624 Outer wall of inner cap member
628 Inner threads of outer cap member
632 Inner wall of outer cap member
636 Very fine holes or perforations, or gas permeable membrane section
640 Top wall of inner cap
644 Path of escaping gas
648 Gasket
652 Gasket
700 Seventh embodiment of foam eliminating cap
704 Inner cap member
708 Outer flip top
712 Hinge means
716 Inner threads of inner cap member
720 Inner wall of inner cap member
724 First serration
728 Second serration
732 Outer wall of inner cap member
736 Top of inner cap member
740 Actuating ledge or handle
744 Interior notch of outer flip top
748 Gasket
752 Gasket

What is claimed is:

1. A pressure equalizing and foam eliminating cap for a container for gas/liquid mixtures having a mouth comprising:

a. cap means for being mated to and detached from said mouth;

b. advancing means, incorporated in said cap means, for allowing said cap means to be repatedly opened from a fully closed position to a gas venting position to a fully open position and closed from said filly open position to said gas venting position to said fully closed position;

c. seal means mounted inside said cap means for sealing said cap means to said mouth when said cap means is in said fully closed position; and d. pressure release means, incorporated in said cap means, for allowing gas at pressures greater than ambient and not liquid to vent from said container when said cap means is in said gas venting position;

whereby said container can be in one of the three following conditions: a) completely sealed so that no gas or liquid can escape, when said cap is in said fully closed position; b) slightly opened so that excess gas only and not liquid can be vented from said container, when said cap is in said gas venting position; and c) fully opened so that liquid can be poured from said container.

2. A cap as claimed in claim 1 further comprising means for tamper proofing.

3. A cap as claimed in claim 1 in which:

a. said cap means has an underside;

b. said gasket means comprises:

i. an inner, flexible, annular seal depending from said underside and located close to the center of said underside; and c. said pressure release means comprises:

i. an outer, flexible, annular seal depending from said underside and located further away from said center than said inner seal; said outer seal having a transverse perforation; said outer seal being longer than said inner seal;

said inner, flexible, annular seal being designed to mate with said outer, flexible, annular seal and close off said perforation when said cap means is fully screwed onto said mouth and to separate from said outer, flexible, annular seal and open up said perforation when said cap means is partially unscrewed and said outer, flexible annular seal is still in contact with said mouth.

4. A cap as claimed in claim 1 in which:

a. said seal means is annular;

b. said cap means comprises:

i. an inner cap member, having a top, adapted to mate with said mouth;

ii. a cover member;

iii. holding means mounted between said inner cap member and said cover member for allowing said cover member to move from a position where it closes off said top to a position where it allows access to said top;

iv. locking means for holding said cover in a closed position relative to said inner cap member; and v. pressure release means for holding said cover in a pressure release position relative to said inner cap member; and c. said pressure release means comprises:

i. a gas separation section located approximately centrally in said top.

5. A cap as claimed in claim 1 in which said cap means can be advanced continuously between said positions.

6. A cap as claimed in claim 5 in which said advancing means is a thread.

7. A cap as claimed in claim 1 in which:

a. said cap means has an underside;

b. said seal means is annular; and c. said pressure release means comprises:

i. a spring, having an opening, a first end and a second end, attached at said first end to said underside; and ii. a gas separation membrane sized to fit inside said seal means and attached to said second end.

8. A cap as claimed in claim 7 in which said gas separation membrane is hydrophobic with a pore size less than 0.2 microns and a water breakthrough pressure of at least 15 psi.

9. A cap as claimed in claim 1 in which:

a. said seal means is annular;

b. said cap means comprises:

i. an inner, threaded cap member, adapted to mate with said mouth; said inner cap member having a top and external threads; and ii. an outer threaded cap member, adapted to mate internally with the external threads of said inner cap; and c. said pressure release means comprises:

i. a gas separation section located approximately centrally in said top.

10. A cap as claimed in claim 9 further comprising a stop means for limiting relative rotation between said inner threaded cap member and said outer threaded cap member.

11. A cap as claimed in claim 1 in which:

a. said cap means has an underside;

b. said seal means is annular; and c. said pressure release means comprises:

i. an annular plug, having a bottom, an outside and an inside, depending from said underside, designed to slidably mate with the interior of said mouth so that a gap is created between said plug and said interior; said plug having a central area having a transverse perforation;

ii. a lower flexible seal means secured to said outside below said central area, for positively sealing said gap; and iii. an upper flexible seal means secured to said outside above said central area, for positively sealing said gap.

12. A cap as claimed in claim 11 further comprising an annular gasket of gas separation membrane attached to said inside around said central area.

13. A cap as claimed in claim 11 further comprising a gasket of gas separation membrane attached across said bottom.

14. A cap as claimed in claim 1 in which:

a. said cap means has an underside;

b. said seal means is annular; and c. said pressure release means comprises:

i. a plug, having an outside, depending from said underside, designed to slidably mate with the interior of said mouth so that a gap is created between said plug and said interior; and ii. a first flexible seal having an outside surface secured to said outside for bridging said gap; said first flexible seal designed so that said outside surface slides against said interior; said outside surface having axial micro-roughness.

15. A cap as claimed in claim 14 further comprising a second flexible seal having an outside surface secured to said outside below said first flexible seal for bridging said gap; said second seal designed so that said outside surface slides against said interior; and in which said plug has a transverse perforation between said flexible seals.

16. A cap as claimed in claim 14 further comprising a third flexible seal having an outside surface secured to said outside above said first flexible seal for abridging said gap; said second seal designed so that said outside surface slides against said interior.

17. A cap as claimed in claim 1 in which:

a. said cap means has an underside;

b. said seal means is annular; and c. said pressure release means comprises:

i. an annular plug, having a bottom, an outside and an inside, depending from said underside, designed to slidably mate with the interior of said mouth so that a gap is created between said plug and said interior; said plug having a central area having a transverse perforation; and ii. a flexible seal means on said outside, below said central area, for sealing said gap.

18. A cap as claimed in claim 17 further comprising an annular gasket of gas separation membrane attached to said inside around said central area.

19. A cap as claimed in claim 17 further comprising a gasket of gas separation membrane attached across said bottom.

20. A cap as claimed in claim 17 in which said perforation is formed by a laser beam.

21. A cap as claimed in claim 20 in which said transverse perforation has a diameter of 0.003 inches or less.

* * * * *